US006024232A

United States Patent [19]

Helgesson

[11] Patent Number: 6,024,232

[45] Date of Patent: Feb. 15, 2000

[54] BOOM TRUCK

[75] Inventor: Kenneth Helgesson, Lidhult, Sweden

[73] Assignee: Kalmar Industries Sverige AB, Ljungby, Sweden

[21] Appl. No.: 09/200,471

[22] Filed: Nov. 27, 1998

Related U.S. Application Data

[63] Continuation of application No. PCT/SE98/01374, Jul. 13, 1998.

[51] Int. Cl.[7] ..... B66C 23/69

[52] U.S. Cl. ..... 212/291; 180/89.13; 212/264; 414/718

[58] Field of Search ..... 212/290, 291, 212/299, 300, 230, 231, 232, 264; 180/89.13, 89.14; 414/718

[56] References Cited

U.S. PATENT DOCUMENTS

| | | | |
|---|---|---|---|
| 3,595,409 | 7/1971 | Bowman-Shaw | 180/89.13 |
| 3,944,277 | 3/1976 | Cyphert . | |
| 3,963,132 | 6/1976 | Dufour . | |
| 3,964,779 | 6/1976 | Benson . | |
| 4,047,618 | 9/1977 | Kuester . | |
| 4,216,869 | 8/1980 | Grove . | |
| 4,436,169 | 3/1984 | Jennerjohn et al. | 180/89.14 |
| 4,627,499 | 12/1986 | Magee et al. . | |
| 4,630,700 | 12/1986 | Larsson . | |
| 4,682,666 | 7/1987 | Klee et al. | 180/89.13 |
| 4,986,721 | 1/1991 | Lowder et al. . | |
| 4,995,469 | 2/1991 | Mikkelsen et al. | 180/89.13 |
| 5,098,018 | 3/1992 | Hadar et al. | 180/89.13 |
| 5,199,861 | 4/1993 | Merlo et al. . | |
| 5,478,192 | 12/1995 | Bentivoglio . | |
| 5,595,313 | 1/1997 | Kroll et al. | 212/225 |
| 5,842,589 | 12/1998 | Kroll et al. | 212/231 |

FOREIGN PATENT DOCUMENTS

| | | | |
|---|---|---|---|
| 0113335 | 7/1984 | European Pat. Off. . | |
| 2020061 | 7/1970 | France . | |
| 2362072 | 3/1978 | France . | |
| 2103278 | 12/1971 | Germany . | |
| 2227593 | 1/1973 | Germany | 212/232 |
| 4-19219 | 1/1992 | Japan . | |
| 1518798 | 7/1978 | United Kingdom . | |
| 2078634 | 1/1982 | United Kingdom . | |

*Primary Examiner*—Thomas J. Brahan
*Attorney, Agent, or Firm*—Nixon & Vanderhye P.C.

[57] ABSTRACT

A boom truck is provided which has optimum operating and transport positions. In the operating position an operator's cab is mounted substantially centrally of the chassis of the boom truck, with the boom above the cab and pivotally mounted to the rear of the cab (over the rear axle) for rotation about a first horizontal axis to provide a lifting force when the boom is pivoted by a hydraulic cylinder or similar linear actuators. In transforming the boom truck to an ease of transport position, the cab is slid on rails to one side of the chassis (preferably in the direction substantially parallel to the axles of the chassis), the support for mounting the pivot for the boom is itself pivoted about a second substantially horizontal axis so that the boom lowers, and ultimately the boom moves to a position next to the cab, with at least part of the boom, and perhaps substantially all of the boom, below the top of the cab.

19 Claims, 2 Drawing Sheets

BOOM TRUCK

CROSS-REFERENCE TO RELATED APPLICATION

This application is a continuation of PCT/SE98/01374 filed Jul. 13, 1998.

BACKGROUND AND SUMMARY OF THE INVENTION

Conventional boom trucks such as shown in U.S. Pat. Nos. 4,047,618 and 4,986,721, and French patent publication 2362072, typically either have the cab centrally located and the boom mounted above the cab, or have the cab offset on the chassis (at one side of the chassis) with the boom typically below the chassis in a transport position. In the first situation, the operator in the cab has excellent visibility when operating the boom but the boom truck has a high profile so that it is difficult to properly transport either directly over the roadway, or on some other vehicle. In the latter case, the truck can have a low profile so that it is relatively easy to transport, however the operator when operating the boom does not have a perspective that is as worthwhile as when the cab is located in the central portion of the chassis.

According to the present invention a boom truck is provided that has the advantages of both of the different prior art constructions described above. The boom truck according to the present invention, when in an operating position, has the boom above the cab with the cab centrally located for good operator visibility. However when it is desired to transport the truck, the cab is moved to one side of the chassis, and the boom is lowered to a position where at least a portion (or substantially all) of the boom is below the top of the cab, for ease of transport. The operation of the truck according to the invention, providing for effective movement of the cab between operating and ease of transport positions, is much simpler than in other known configurations in which the cab position is movable for various reasons, such as shown in U.S. Pat. Nos. 3,963,132 and 4,630,700.

According to one aspect of the present invention a boom truck is provided comprising the following components: A chassis having a front end and a rear end, first and second sides, a front axle mounting front wheels, and a rear axle mounting rear wheels. A cab having a top, and positioned on the chassis between the chassis front and rear ends. A boom. A support for the boom mounted between the cab and the chassis rear end. The boom pivotally mounted to the support for pivotal movement about a first, substantially horizontal, axis extending in an imaginary line intersecting the chassis sides. The cab movable with respect to the chassis from a first position positioned beneath the boom, to a second position to one side of the boom so that the boom may be positioned next to the cab with at least a portion of the boom below the top of the cab. And, the boom movable from a first position in which the boom is above the cab when the cab is in the cab first position, and a second position in which the boom is next to the cab when the cab is in the cab second position with a least a portion of the boom below the top of the cab.

The boom truck according to the invention typically further comprises linear tracks (preferably substantially parallel to the first axis) mounted on the chassis and cooperable with the cab for providing movement of the cab between the first and second positions thereof. Preferably the cab is mounted between the axles and is centrally located on the chassis when in the first position.

Preferably the support comprises a stand having a first portion mounted to the chassis for pivotal movement about a second axis substantially parallel to the first axis, and a second portion which mounts the boom for movement about the first axis; and the boom truck further comprises at least one actuator operatively connected to the stand for moving the stand about the second axis so that the boom moves between the first and second positions. The stand typically further comprises a third portion which engages the chassis when the boom is in the first position, and which is disengaged from the chassis when the boom is in the second position. The boom truck may further comprise a locking element for locking the stand third portion to the chassis to prevent rotatable movement of the stand about the second axis unless a locking element has been released; for example the stand at the third portion may comprise a support plate, and the locking element may comprise a plurality of bolts (or other screw threaded fasteners) releasably connecting the support plate to the chassis. The stand typically comprises a pair of substantially triangularly shaped plates each having first, second, and third apices comprising the first, second, and third portions of the stand. Typically the first and second axes are substantially directly above the rear axle when the boom is in the first position.

According to another aspect of the present invention a method of utilizing a boom truck such as described above is provided. The method comprises: When it is desired to transport the boom truck over a roadway in a low volume configuration, (a) substantially horizontally moving the cab to a position horizontally displaced from the boom, and (b) lowering the boom so that it is next to the cab with a least a portion of the boom below the top of the cab; and, when it is desired to use the boom truck for lifting or exerting a force on objects, (c) raising the boom so that it is substantially above the top of the cab, and (d) substantially horizontally moving the cab so that the cab is below the boom.

The method as described above may further comprise, when the cab and boom are in the positions to which they have been moved by the practice of (c) and (d), (e) pivoting the boom about the first axis using the at least one linear actuator so that the front end thereof moves vertically to provide a lifting force on objects connected to the boom front end. Procedure (b) may also be practiced by pivoting the support about the second axis using at least one linear actuator connected between the chassis and the support. There may also be, prior to the practice of (e), the procedure (f) of locking the support to the chassis so that the support cannot move about the second axis.

According to another aspect of the present invention a boom truck is provided comprising the following components: A chassis having a front end and a rear end, first and second sides, a front axle mounting front wheels, and a rear axle mounting rear wheels. A boom. A support for the boom mounted on the chassis adjacent the chassis rear end. The boom pivotally mounted to the support for pivotal movement about a first, substantially horizontal, axis extending substantially parallel to the front and rear axles. The support comprising a stand having a first portion mounted to the chassis for pivotal movement about a second axis substantially parallel to the first axis, and a second portion which mounts the boom for movement about the first axis. At least one actuator operatively connected to the stand for moving the stand about the second axis so that the boom moves between operating and ease-of-transport positions. A third portion of the stand which engages the chassis when the boom is in the operating position, and which is disengaged from the chassis when the boom is in the ease-of-transport position. And, a locking element for locking the stand third portion to the chassis to prevent pivotal movement of the stand about the second axis unless the locking element has been released. The details of the components are preferably as described above.

It is the primary object of the present invention to provide a simple yet effective apparatus and method for allowing effective operation of a boom truck, yet also ease of transport thereof. This and other objects of the invention will become clear from an inspection of the detailed description of the invention and from the appended claims.

DETAILED DESCRIPTION OF THE DRAWINGS

Figure 1:
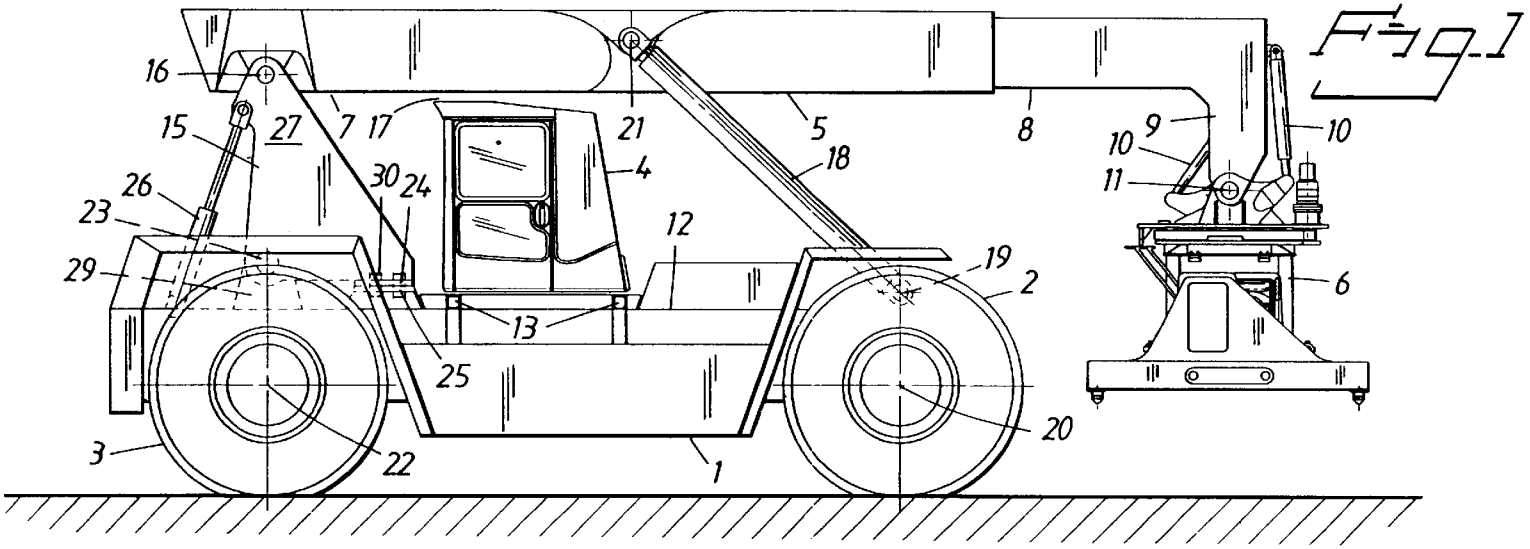
FIG. 1 is a side view of an exemplary boom truck according to the present invention in a first, operating, position of the cab and boom, for manipulating a load.

The drawings schematically show a truck of the type generally termed a boom truck. The truck has a chassis 1 having front and rear ends and sides, a front axle 20 with a pair (or more) of wheels 2 and a rear axle 22 with a pair (or more) of wheels 3, a driver's cab 4 between the pairs of wheels 2, 3, a long, telescopic boom 5 extending centrally above the chassis 1 from a point approximately above the rear axle 22, past the front wheels 2 and to a point in front of the front wheels 2 and the front end of chassis 1. The lifting boom 5 supports a conventional lifting unit 6 and preferably comprises a hollow main body or outer boom 7 with rectangular cross section and an outer telescopic arm or inner boom 8 with rectangular cross section, protruding from the outer boom 7. The telescopic arm is preferably L-shaped, having a downwardly directed part 9 which at its free end supports the lifting unit 6, the latter having an engagement body arranged to be set in desired positions in relation to the boom 5 by linear displacement and/or turning. Two hydraulic cylinders 10, or like linear actuators, are provided for this turning movement and are mounted on the telescopic arm 8 and lifting unit 6 to turn about a horizontal shaft 11 located perpendicular to the lifting boom 5. In alternative embodiments the lifting boom 5 may have one or more intermediate telescopic arms. Extension and withdrawal of the outer telescopic arm 8 in relation to the main body 7 is preferably effected hydraulically using suitable conventional hydraulic cylinders (not shown) in the main body 7, and the telescopic arm 8 thus functions as a piston rod.

A platform 12 is positioned horizontally on the chassis 1 between the front and rear axles 20, 22. Two parallel rails 13 are rigidly mounted on the platform 12 and extend perpendicularly to the longitudinal center line 14 of the truck. The cab 4 is provided on its lower side with two parallel conventional rail-engagement elements (not shown), which cooperate with the rails 13, enabling the cab 4 to be moved (slid) horizontally along the rails 13, preferably in a direction substantially parallel to the axles 20, 22. Displacement of the cab 4 is preferably achieved in controlled manner with the aid of suitable actuator, e.g. a conventional hydraulic cylinder (not shown). The rails 13 extend from an inner position on the truck on one side of the center line 14 to an outer position on the truck on the other side of the center line 14 so that the outer ends of the rails 13 are situated in line with the wheels 2, 3 on the relevant side of the truck. The rails 13 and cab 4 arrangement is thus such that the cab 4 can be set in a first, inner, operating, position (FIGS. 1 and 2) in the middle of the truck where the lifting boom 5 is located vertically above the cab 4, and a second, outer side, ease of transport, position (FIGS. 3 and 4) on one side of the truck so that no part of the cab 4 is within the area of the lifting boom 5 and its associated equipment, seen in vertical projection of the lifting boom and the equipment increasing its width.

The lifting boom 5 is pivotally journalled on a support, e.g. a first portion of a mounting stand 15, for rotation about a first axis of rotation 16, the stand 15 positioned on the chassis 1 adjacent the rear end of the truck above the rear axle 22. The stand 15 extends upwardly a predetermined distance from the chassis 1 so that the first axis of rotation 16 of the lifting boom 5 is situated on the stand 15 at such a level that a small space vertical 17 exists between the cab 4 and the lifting boom 5 when the lifting boom 5 is in its lowermost, horizontal position in operating state of the truck, as shown in FIG. 1, with boom 5 substantially directly above cab 4.

Pivoting of the lifting boom 5 about the axis of rotation 16 is achieved with the aid of at least one linear actuator, e.g. two forward hydraulic cylinders 18, the lower ends of which are pivotably journalled on the chassis 1 or on elements rigidly connected to the chassis, and the upper ends of which are pivotably journalled on the lifting boom 5. The lower coaxial journalling shafts 19 of the hydraulic cylinders 18 are situated vertically above the center axle 20 of the front wheels 2, while the upper coaxial journalling shafts 21 are situated a predetermined distance from the axis of rotation 16 of the lifting boom on the stand 15 in order to provide sufficient lifting capacity. These journalling shafts 21 are normally situated above a central region of the truck seen in the lowermost horizontal position of the lifting boom 5 when the truck is in operating state as shown in FIG. 1. The hydraulic cylinders 18 thus preferably form an acute angle, such as 40–50°, with the horizontal plane, when the boom 5 is substantially horizontal (as seen in FIG. 1).

In the operating state of the truck according to FIG. 1, the axis of rotation 16 of the lifting boom 5 on the stand 15 is situated substantially directly vertically above the center axle 22 of the rear wheels 3, the center axle 22 being substantially perpendicular to the center line 14 of the truck.

Figure 2:
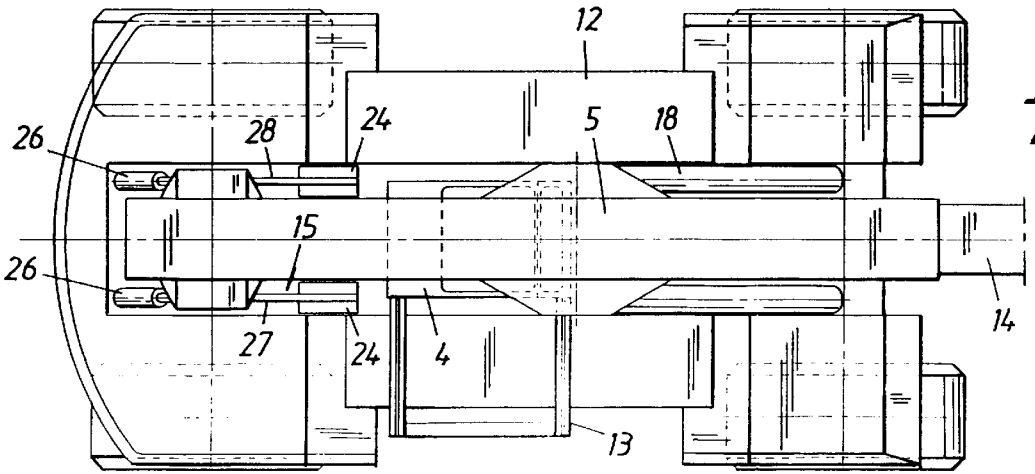
FIG. 2 is a top view of the boom truck in the position of FIG. 1.

The stand 15 is pivotably journalled to the chassis at a second portion thereof for rotation about a lower, second, axis of rotation 23 which is stationary with regard to chassis 1, and is situated substantially directly vertically above the center axle 22 of the rear wheels 3, and thus substantially directly vertically below the axis of rotation 16 of the lifting boom 5 on the stand 15 when the truck is in its operating state for manipulating a load. The stand 15 extends forward toward the cab 4 and is provided on the extended part (a third portion) thereof with one or more support elements (e.g. plates) 24 cooperating with corresponding support elements 25 on the chassis 1 in the operating state of the truck (FIGS. 1 and 2). Part of the load from the lifting boom 5, the lifting unit 6, and any load being carried, is transferred to the chassis 1 via these support elements 24, 25. The support elements 24, 25 are situated at a predetermined distance from and in front of the second axis of rotation 23; the predetermined distance is suitably about 40–60% of the distance between the first and second axes of rotation 16, 23.

On the side of the stand 15 facing away from the support element 24 there is at least one linear actuator, e.g. two hydraulic cylinders 26, the lower ends of which are pivotably journalled on the chassis 1 at a predetermined distance from the axis of rotation 23 of the stand 15, and the upper ends of which are journalled on the stand 15 at an upper portion thereof in the vicinity of the axis of rotation 16 of the lifting boom 5 on the stand 15. The hydraulic cylinders 26 have a stabilizing effect on the stand 15 when the stand 15 is rotated about its axis of rotation 23.

Figure 4:
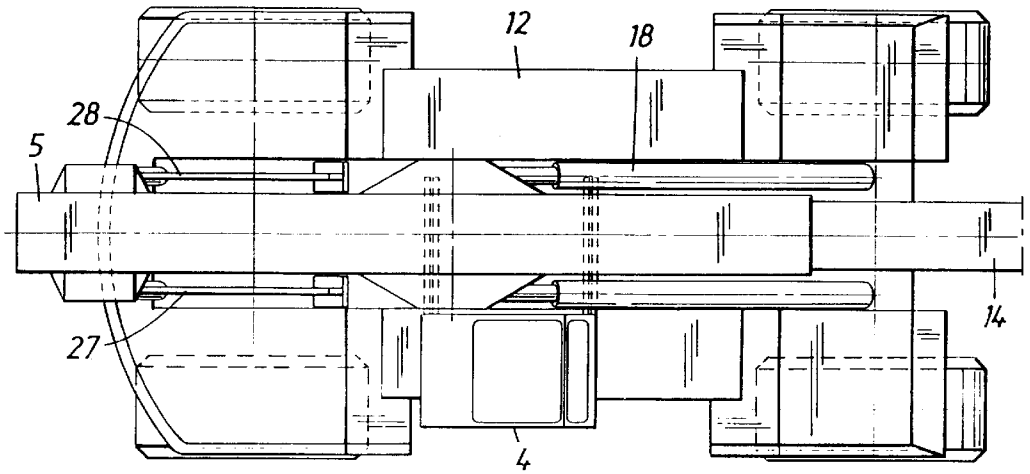
FIG. 4 is a top view of the boom truck in the second position of FIG. 3.

In the embodiment shown in FIGS. 2 and 4, the stand 15 comprises two substantially parallel, generally triangular plates 27, 28, resembling link arms, which are situated one on each side of the lifting boom 5 and are pivotably journalled on coaxial journalling pins forming the second axis of rotation 23. The support elements 24 of the stand 15 are formed by a flat support element (e.g. plate) on each stand plate 27, 28, situated at the inner corner of the support plate 27, 28 and at its base (the chassis 1 being provided with a corresponding support element 25). Each of the two rear hydraulic cylinders 26 is connected to a stand plate 27, 28 in the vicinity of its upper corner which also constitutes the journalling point for a journalling pin, these coaxial journalling pins forming the axis of rotation 16 of the lifting boom 5 on the stand 15. Each stand plate 27, 28 is pivotably journalled by journalling pins on mounting lugs 29 extending upwardly from the chassis 1, the coaxial journalling pins forming the lower axis of rotation 23 of the stand 15 on the chassis 1.

The arrangement also includes a locking device 30 for locking the stand 15 to the chassis 1 when the truck assumes its operating state to manipulate a load. In the embodiment shown in FIGS. 1 and 2, the locking device comprises suitable threaded fasteners, such as bolts or screws, cooperating with the support elements 24, 25 to form a detachable screw joint. The locking device 30 may be of any type that provides the desired locking function with maximum safety. Device 30 may also include one or more hydraulic locking devices (not shown), suitably spring loaded, so that a locking position is always assumed by a suitable locking element, e.g. a locking wedge, even if for some reason the hydraulic system is out of action.

Figure 3:
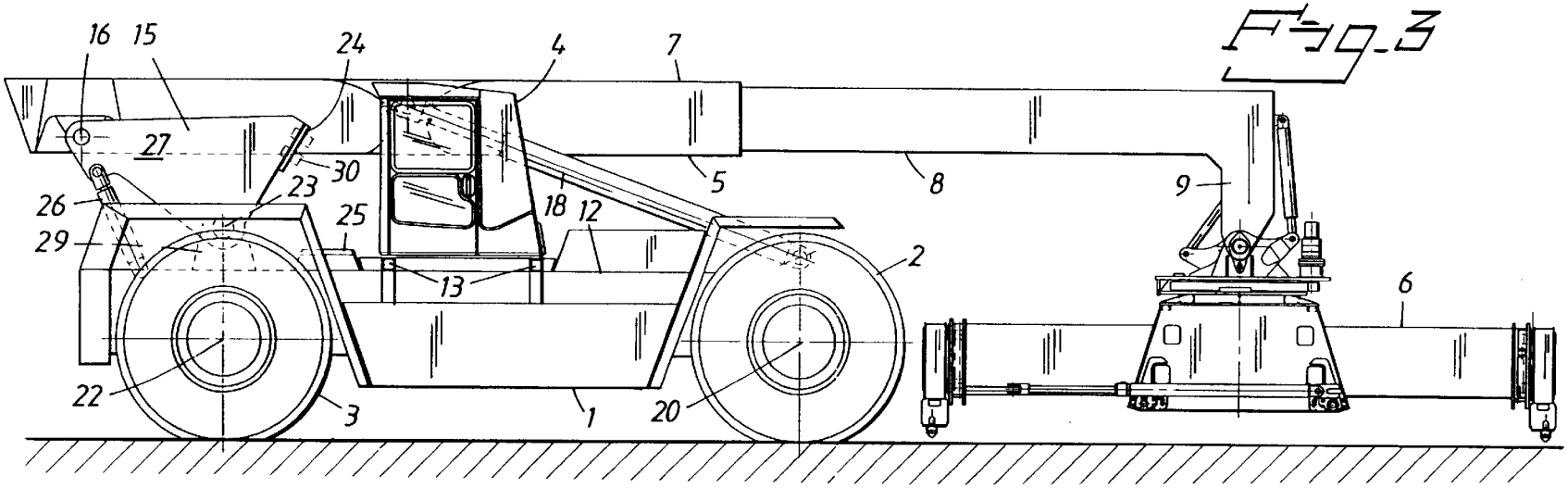
FIG. 3 is a side view of the boom truck of FIG. 1 when in a second, ease of transport, position with reduced total height.

The truck is adapted to be changed to the ease of transport state shown in FIGS. 3 and 4 when desired. In this state the truck has reduced total height in comparison with the lowest height the truck has in its operating state as shown in FIG. 1. The first measure taken is for the cab 4 to be moved from its central location to its side location (seen best in FIG. 4) on the truck, in which it is situated outside a vertical projection of the lifting boom 5 and the hydraulic cylinders 18 with associated mounting equipment at the sides. The locking device 30 is then released so that the stand 15 can be turned freely backwards. The rear hydraulic cylinders 26 are then activated to retract their piston rods, at the same time as the hydraulic cylinders 18 of the lifting boom 5 are activated to press out their piston rods (see FIG. 4).

The hydraulic cylinders 18 of the lifting boom 5 will thus displace the lifting boom 5 backwardly at the same time as the hydraulic cylinders 26 of the stand 15 pull the stand 15 backwardly and downwardly, and the support elements 24 of the stand 15 leave the support elements 25 of the chassis 1. The stand 15 is rotated about the second axis of rotation 23 and the first axis of rotation 16 of the lifting boom 5 will thus circumscribe a circular arc. The lifting boom 5 will then assume a horizontal position with its upper side on a level with the roof of the cab 4 or just above it, e.g. less than 10 cm and preferably less than 5 cm above the roof. In general, therefore, when the truck is in its ease-of-transport state the lower side of the lifting boom is situated beneath the level of the roof of the cab 4 (e.g. substantially all of the boom 5 may be below the top of cab 4), which is now in its side position, so that the distance between the lower side of the lifting boom and the level of the roof may be equivalent to the thickness of the lifting boom (which may be 40–80 cm, for instance) in the vertical direction, seen in the transport state of the truck, or somewhat less than this according to the above values. The total height of the truck thus has been quickly and simply considerably reduced and the truck can thus pass through underpasses or the like not previously accessible to this type of truck.

It will thus be seen that according to the present invention a simple yet effective boom truck, and a method of utilization thereof, have been provided which allow the boom truck to have optimum operating and transport positions. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A boom truck comprising:

a chassis having a front end and a rear end, first and second sides, a front axle mounting front wheels, and a rear axle mounting rear wheels;

a cab having a top, and positioned on said chassis between said chassis front and rear ends;

a boom;

a support for said boom mounted between said cab and said chassis rear end;

said boom pivotally mounted to said support for pivotal movement about a first, substantially horizontal, axis extending in an imaginary line intersecting said chassis sides;

said cab movable with respect to said chassis from a first position positioned beneath said boom, to a second position to one side of said boom so that said boom may be positioned next to said cab with at least a portion of said boom below said top of said cab;

said boom movable from a first position in which said boom is above said cab when said cab is in said cab first position, and a second position in which said boom is next to said cab when said cab is in said cab second position with a least a portion of said boom below said top of said cab;

wherein said support comprises a stand having a first portion mounted to said chassis for pivotal movement about a second axis substantially parallel to said first axis, and a second portion which mounts said boom for movement about said first axis; and at least one actuator operatively connected to said stand for moving said stand about said second axis so that said boom moves between said first and second positions.

2. A boom truck as recited in claim 1 further comprising linear tracks mounted on said chassis and cooperable with said cab for providing movement of said cab between said first and second positions thereof.

3. A boom truck as recited in claim 2 wherein said linear tracks are substantially parallel to said first axis; wherein said cab is mounted between said axles, and is centrally located on said chassis when in said first portion.

4. A boom truck as recited in claim 1 wherein said stand further comprises a third portion which engages said chassis when said boom is in said first position, and which is disengaged from said chassis when said boom is in said second position.

5. A boom truck as recited in claim 4 further comprising a locking element for locking said stand third portion to said chassis to prevent pivotal movement of said stand about said second axis unless said locking element has been released.

6. A boom truck as recited in claim 5 wherein said stand at said third portion comprises a support plate; and wherein said locking element comprises a plurality of screw threaded fasteners releasably connecting said support plate to said chassis.

7. A boom truck as recited in claim 4 wherein said stand comprises a pair of substantially triangularly shaped plates each having first, second, and third apices comprising said first, second, and third portions of said stand.

8. A boom truck as recited in claim 1 wherein said first and second axes are substantially directly above said rear axle when said boom is in said first position.

9. A boom truck as recited in claim 8 further comprising linear tracks substantially parallel to said first axis mounted on said chassis and cooperable with said cab for providing movement of said cab between said first and second positions thereof.

10. A boom truck as recited in claim 1 wherein said first axis is substantially directly above said rear axle when said boom is in said first position.

11. A boom truck as recited in claim 1 further comprising at least one actuator pivotally mounted to said boom and said chassis for pivoting said boom about said first axis.

12. A boom truck as recited in claim 11 wherein said boom has a rear end adjacent said first axis, and a front end which extends past said chassis front end; and further comprising a lifting unit mounted to said boom front end and in front of said chassis front end when said boom is in both said first and second positions; and wherein when said cab and boom are both in said second positions thereof, substantially all of said boom is below said top of said cab.

13. A method of utilizing a boom truck having a chassis with a front axle having front wheels, and a rear axle having rear wheels, a cab mounted on the chassis, a boom operatively pivotally mounted to the chassis, a support which mounts a rear end of the boom for pivotal movement about a substantially horizontal first axis substantially perpendicular to a line between the front and rear ends of the chassis; and at least one linear actuator pivotally mounted to the boom between the front and rear ends of the boom, and to the chassis; said method comprising:

when it is desired to transport the boom truck over a roadway in a low volume configuration, (a) substantially horizontally moving the cab to a position horizontally displaced from the boom, and (b) lowering the boom so that it is next to the cab with a least a portion of the boom below the top of the cab;

when it is desired to use the boom truck for lifting or exerting a force on objects, (c) raising the boom so that it is substantially above the top of the cab, and (d) substantially horizontally moving the cab so that the cab is below the boom; and when the cab and boom are in the positions to which they have been moved by the practice of (c) and (d), (e) pivoting the boom about the first axis using the at least one linear actuator so that the front end thereof moves vertically to provide a lifting force on objects connected to the boom front end.

14. A method as recited in claim 13 wherein the support is mounted for pivotal movement about a second axis substantially parallel to the first axis; and wherein (b) is practiced by pivoting the support about the second axis using at least one linear actuator connected between the chassis and the support.

15. A method as recited in claim 14 wherein prior to practice of (e), further comprising (f) locking the support to the chassis so that the support cannot move about the second axis.

16. A boom truck comprising:

a chassis having a front end and a rear end, first and second sides, a front axle mounting front wheels, and a rear axle mounting rear wheels;

a boom;

a support for said boom mounted on said chassis adjacent said chassis rear end;

said boom pivotally mounted to said support for pivotal movement about a first, substantially horizontal, axis extending substantially parallel to said front and rear axles;

said support comprising a stand having a first portion mounted to said chassis for pivotal movement about a second axis substantially parallel to said first axis, and a second portion which mounts said boom for movement about said first axis;

at least one actuator operatively connected to said stand for moving said stand about said second axis so that said boom moves between operating and ease-of-transport positions;

a third portion of said stand which engages said chassis when said boom is in said operating position, and which is disengaged from said chassis when said boom is in said ease-of-transport position; and a locking element for locking said stand third portion to said chassis to prevent pivotal movement of said stand about said second axis unless said locking element has been released.

17. A boom truck as recited in claim 16 wherein said stand comprises a pair of substantially triangularly shaped plates each having first, second, and third apices comprising said first, second, and third portions of said stand.

18. A boom truck as recited in claim 16 wherein said first and second axes are substantially directly above said rear axle when said boom is in said operating position.

19. A boom truck comprising:

a chassis having a front end and a rear end, first and second sides, a front axle mounting front wheels, and a rear axle mounting rear wheels;

a cab having a top, and positioned on said chassis between said chassis front and rear ends;

a boom having a rear end adjacent said first axis and a front end which extends past said chassis front end;

a support for said boom mounted between said cab and said chassis rear end;

said boom pivotally mounted to said support for pivotal movement about a first, substantially horizontal, axis extending in an imaginary line intersecting said chassis sides;

said cab movable with respect to said chassis from a first position positioned beneath said boom, to a second position to one side of said boom so that said boom may be positioned next to said cab with at least a portion of said boom below said top of said cab;

said boom movable from a first position in which said boom is above said cab when said cab is in said cab first position, and a second position in which said boom is next to said cab when said cab is in said cab second position with a least a portion of said boom below said top of said cab;

at least one actuator pivotally mounted to said boom and said chassis for pivoting said boom about said first axis;

a lifting unit mounted to said boom front end in front of said chassis front end when said boom is in both said first and second positions; and wherein when said cab and boom are in said second positions thereof, substantially all of said boom is below said top of said cab.

* * * * *